US011000129B2

(12) United States Patent
He et al.

(10) Patent No.: US 11,000,129 B2
(45) Date of Patent: May 11, 2021

(54) FLIP HEADREST DEVICE FOR SOFA

(71) Applicant: OKIN REFINED ELECTRIC TECHNOLOGY CO., LTD, Zhejiang (CN)

(72) Inventors: Pengfei He, Zhejiang (CN); Kangming Tao, Zhejiang (CN); Long Li, Zhejiang (CN)

(73) Assignee: OKIN REFINED ELECTRIC TECHNOLOGY CO., LTD, Zhejiang (CN)

( * ) Notice: Subject to any disclaimer, the term of this patent is extended or adjusted under 35 U.S.C. 154(b) by 48 days.

(21) Appl. No.: 16/446,651

(22) Filed: Jun. 20, 2019

(65) Prior Publication Data

US 2020/0100596 A1 Apr. 2, 2020

(30) Foreign Application Priority Data

Sep. 29, 2018 (CN) ..... 201821602422.6
Feb. 20, 2019 (CN) ..... 201920216201.3

(51) Int. Cl.
*A47C 20/04* (2006.01)

(52) U.S. Cl.
CPC ..... *A47C 20/041* (2013.01)

(58) Field of Classification Search
None
See application file for complete search history.

(56) References Cited

U.S. PATENT DOCUMENTS

| | | | | |
|---|---|---|---|---|
| 2,984,293 | A * | 5/1961 | Bontempi | A47C 1/037 297/61 |
| 5,310,243 | A * | 5/1994 | Pine | A47C 7/38 297/403 |
| 5,340,191 | A * | 8/1994 | May | A47C 1/0355 297/403 |
| 7,201,438 | B2 * | 4/2007 | Reinsch | A47C 1/036 297/61 |
| 7,862,110 | B2 * | 1/2011 | Rogers | A47C 7/402 297/61 |
| 9,282,827 | B1 * | 3/2016 | Lu | A47C 20/041 |
| 2016/0227934 | A1 * | 8/2016 | Lu | A47C 7/38 |
| 2016/0302573 | A1 * | 10/2016 | Garland | A47C 1/036 |
| 2017/0127844 | A1 * | 5/2017 | Grone | A47C 7/40 |
| 2018/0027979 | A1 * | 2/2018 | Zhao | A47C 20/041 |
| 2018/0125242 | A1 * | 5/2018 | Lu | A47C 17/04 |
| 2018/0125248 | A1 * | 5/2018 | Li | A47C 7/38 |
| 2019/0069682 | A1 * | 3/2019 | Liu | A47C 20/041 |

* cited by examiner

*Primary Examiner* — David R Dunn
*Assistant Examiner* — Christopher E Veraa
(74) *Attorney, Agent, or Firm* — JCIP Global Inc.

(57) ABSTRACT

A flip headrest device adapted for a sofa includes a sofa frame and a flip mechanism. The sofa frame includes a sofa frame top and two sofa frame sides that are cooperatively connected. The flip mechanism includes a driver rotatably connected in the sofa frame, a flip lever rotatably connected to the driving member, a planar link mechanism cooperatively connected to both ends of the flip lever, and a headrest portion disposed at an upper end of the sofa frame top. The planar link mechanism includes a crank rod, a first link and a second link. The crank rod has one end being fixedly connected to the flip lever, a middle portion being rotatably connected to the first link, and the other end being rotatably connected to the second link. The first and second links pass through the sofa frame top and are rotatably connected to the headrest portion.

19 Claims, 2 Drawing Sheets

FLIP HEADREST DEVICE FOR SOFA

CROSS-REFERENCE TO RELATED APPLICATION

This application claims the priority benefits of Chinese application serial no. 201920216201.3, filed on Feb. 20, 2019, and Chinese application serial no. 201821602422.6, filed on Sep. 29, 2018. The entirety of each of the above-mentioned patent applications is hereby incorporated by reference herein and made a part of specification.

BACKGROUND

Technical Field

The present invention belongs to the technical field of sofas, in particular, relates to a flip headrest device for sofa.

Description of Related Art

Sofa is a very common household item. A headrest of a regular sofa is fixed, and positions and states of the headrest cannot be adjusted according to a posture of a user. There are also some electric sofas in the market, which have a function of adjusting a backrest and improve the user's comfort. However, there is still a lack of function to adjust the headrest.

SUMMARY

In order to make up for the deficiencies of the prior art, the present invention provides a technical solution for a flip headrest device for a sofa.

A flip headrest device is adapted for a sofa and includes a sofa frame and a flip mechanism. The sofa frame includes a sofa frame top and two sofa frame sides that are cooperatively connected. The flip mechanism includes a driving member rotatably connected in the sofa frame, a flip lever rotatably connected to the driving member, a planar link mechanism cooperatively connected to both ends of the flip lever and a headrest portion disposed at an upper end of the sofa frame top. The planar link mechanism includes a crank rod, a first link and a second link. One end of the crank rod is fixedly connected to the flip lever, a middle portion of the crank rod is rotatably connected to the first link, and the other end of the crank rod is rotatably connected to the second link. The first link and the second link both pass through the sofa frame top and are rotatably connected to the headrest portion.

According to an embodiment of the present invention, the first link is fixedly connected to a first link extension, and the planar link mechanism further includes a rocker. One end of the rocker is rotatably connected to a sofa frame side, and the other end of the rocker is rotatably connected to the first link extension.

According to an embodiment of the present invention, the planar link mechanism further includes a third link fixedly connected to one of the sofa frame sides, and both the crank rod and the rocker are rotatably connected to the third link.

According to an embodiment of the present invention, the headrest portion is fixedly connected to a headrest fixing portion, and the headrest fixing portion is rotatably and respectively connected to the first link and the second link.

According to an embodiment of the present invention, the first link and the second link are both plate-shaped structures, wherein one of the first link and the second link is partially or completely covers the other one of the first link and the second link.

According to an embodiment of the present invention, the sofa frame top defines two sofa frame top openings for the first link and the second link passing therethrough.

According to an embodiment of the present invention, the driving member is an electric push rod.

According to an embodiment of the present invention, a return spring is disposed between a push rod of the electric push rod and a lower end of the sofa frame.

According to an embodiment of the present invention, a fixing base is fixedly connected between the two sofa frame sides, and a lower end of the driving member is rotatably connected to the fixing base.

Compared with the prior art, the present invention provides a flip mechanism, which may automatically realize the flip function of the headrest and enhance the comfort of the sofa.

DESCRIPTION OF THE EMBODIMENTS

The present invention will be further elaborated hereafter in connection with the drawings.

Figure 1:
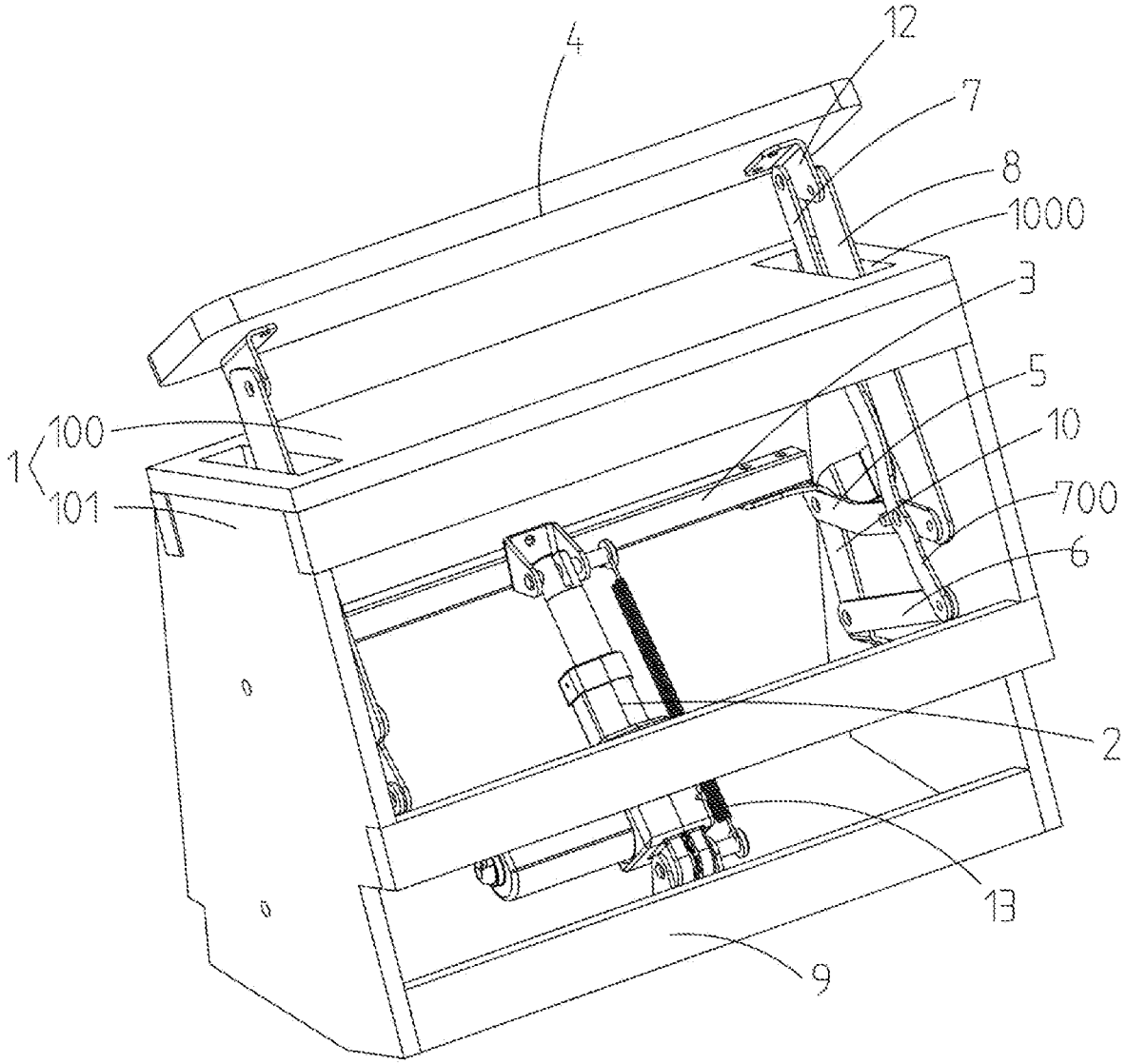
FIG. 1 is a perspective view of a structure of the present invention.
Figure 2:
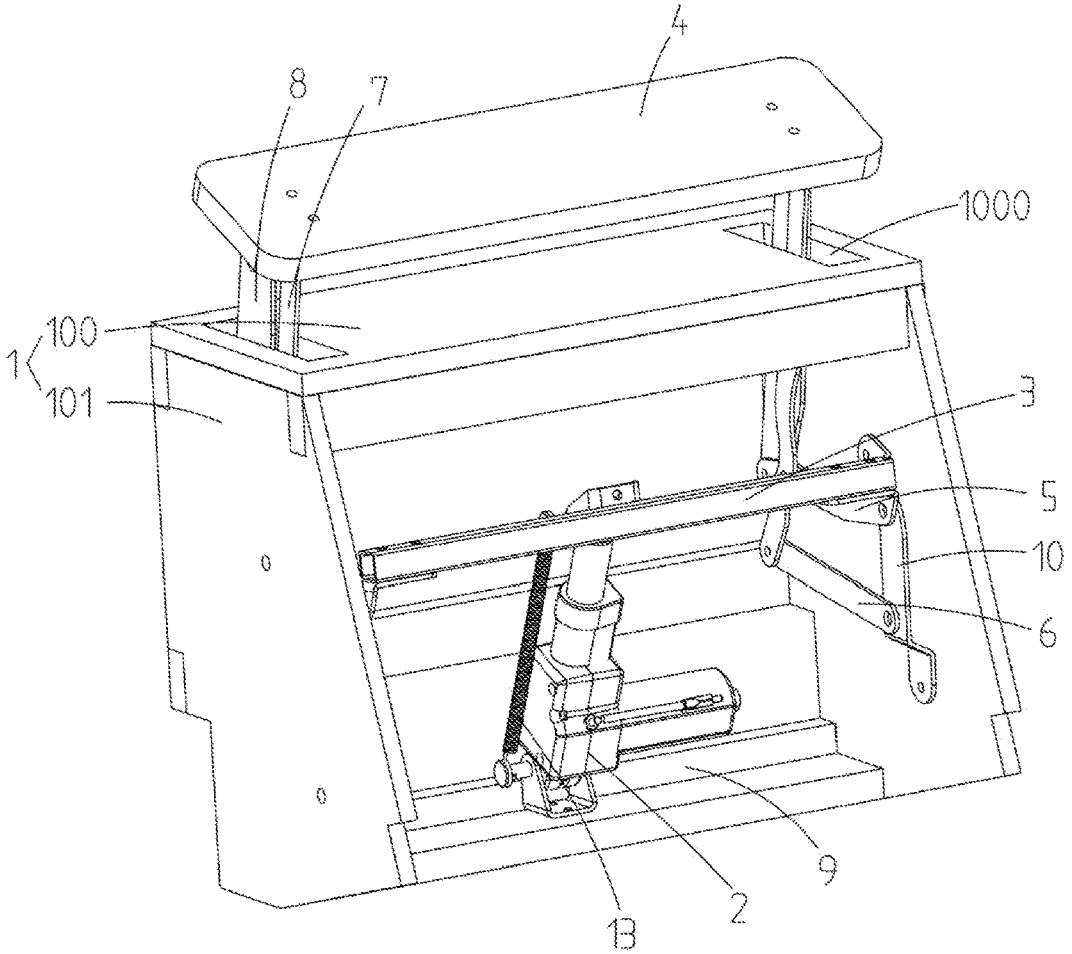
FIG. 2 is another perspective view of the structure of the present invention.
Figure 3:
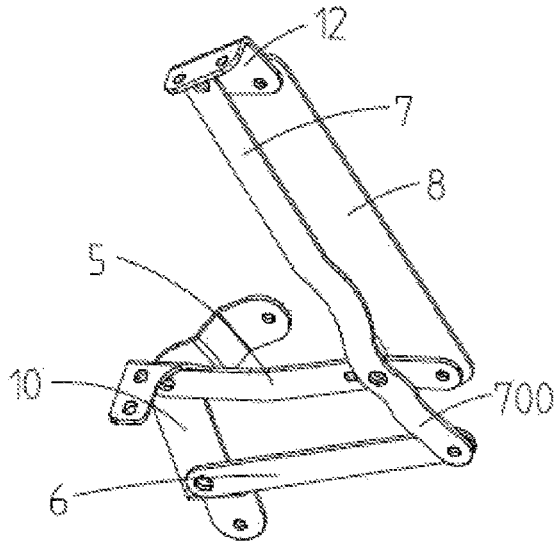
FIG. 3 is a structural view of a planar link mechanism in the present invention.

As shown in FIGS. 1, 2 and 3, a flip headrest device is adapted for a sofa. The flip headrest device includes a sofa frame 1 and a flip mechanism. The sofa frame 1 including a sofa frame top 100, two sofa frame sides 101 fixedly connected to both sides of the sofa frame top 100, and a fixing base 9 fixedly connected between lower ends of the two sofa frame sides 101.

The flip mechanism includes a driving member 2 with a lower end hinged to the fixing base 9, a flip level 3 hinged to an upper end of the driving member 2, a planar link mechanism cooperatively connected to both ends of the flip lever 3, and a headrest portion 4 disposed at an upper end of the sofa frame top 100. Among them, the driving member 2 is an electric push rod. The planar link mechanism includes a crank rod 5, a first link 7, a second link 8, a rocker 6, and a third link 10. The third link 10 is fixedly connected to one of the sofa frame sides 101, and the third link 10 is hinged to the crank rod 5 and the rocker 6 respectively. One end of the crank rod 5 is fixedly connected to the flip lever 3, a middle portion of the crank rod 5 is hinged to the first link 7, and the other end of the crank rod 5 is hinged to the second link 8. The first link 7 and the second link 8 both pass through the sofa frame top 100 and are hinged to the headrest 4. The first link 7 is relatively closer to the headrest 4, and the second link 8 is relatively farther from the headrest 4. The first link 7 is fixedly connected to the first link extension 700, and a hinge position of the first link 7 and the crank rod 5 is located between the first link 7 and the first link extension 700. The rocker 6 is hinged to the first link extension 700. The first link 7 and the second link 8 are both plate-shaped structures with a misaligned design therebetween, wherein from a side perspective, the second link 8 partially covers the first link 7, and the first link 7 may also be designed to cover the second link 8. The purpose is as follows. From a side projection perspective, the first link 7 and the second link 8 do not have a large or obvious gap during operation, thereby preventing human body or foreign matter from entering, such that product safety and reliability are ensured while improving aesthetics.

In addition, a lower end of the electric push rod and the fixing base 9 are hinged by a conventional hinge base, and a return spring 13 is disposed between an upper end of the push rod of the electric push rod and the hinge base. The headrest portion 4 is fixedly connected to the headrest fixing portion 12. The headrest n fixing portion 12 is an L-shaped and plate-shaped structure, and the headrest fixing portion 12 is hinged to the first link 7 and the second link 8, respectively. The sofa frame top 100 defines two sofa frame top openings 1000 for the first link 7 and the second link 8 to pass therethrough.

In operation, the third link 10, the crank rod 5, the rocker 6 and the first link extension 700 constitute a first planar four-link mechanism, and the crank rod 5, the first link 7, the second link 8, and the headrest fixing portion 12 also constitute a second planar four-link mechanism. The driving member 2 pushes the flip lever 3 to flip, and the flip lever 3 drives the first planar four-link mechanism to be folded upward, thereby causing the second planar four-link mechanism to be folded and tilted. When the crank rod 5 rotates, the headrest fixing portion 12 and the headrest portion 4 rotate accordingly, and the headrest portion 4 may achieve following actions. From lying parallel to the upper end of the sofa frame top 100 to "rising" from the upper end of the sofa frame top 100. At the time of reset, the driving member 2 stops operating and is automatically reset by a pulling force of the return spring 13.

When the present invention is not in use, the headrest portion 14 is horizontally disposed at the upper end of the sofa frame top 100. When the present invention is in use, the headrest portion 14 is raised from the sofa frame top 100 for a head of a user to abut thereagainst.

What is claimed is:

1. A flip headrest device adapted for a sofa, the flip headrest comprising a sofa frame and a flip mechanism, the sofa frame including a sofa frame top and two sofa frame sides that are cooperatively connected, the flip mechanism including a driving member rotatably connected in the sofa frame, a flip lever rotatably connected to the driving member, a planar link mechanism cooperatively connected to both ends of the flip lever, and a headrest portion disposed at an upper end of the sofa frame top, the planar link mechanism including a crank rod, a first link and a second link, wherein the crank rod has a first section and a second section that is bent and extending from the first section and cooperatively forms an L-shaped with the first section, one end, on the second section, of the crank rod is directly and fixedly connected to the flip lever, a middle portion of the first section of the crank rod is rotatably connected to the first link, the other end, away from the second section, of the crank rod is rotatably connected to the second link, and the first link and the second link both passing through the sofa frame top and being rotatably connected to the headrest portion.

2. The flip headrest device according to claim 1, wherein the first link is fixedly connected to a first link extension, and the planar link mechanism further includes a rocker, one end of the rocker being rotatably connected to one of the sofa frame sides and the other end of the rocker being rotatably connected to the first link extension.

3. The flip headrest device according to claim 2, wherein the planar link mechanism further includes a third link fixedly connected to one of the sofa frame sides, and both the crank rod and the rocker are rotatably connected to the third link.

4. The flip headrest device according to claim 3, wherein the headrest portion is fixedly connected to a headrest fixing portion, and the headrest fixing portion is rotatably and respectively connected to the first link and the second link.

5. The flip headrest device according to claim 3, wherein the first link and the second link are both plate-shaped structures, one of the first link and the second link is partially or completely covers the other one of the first link and the second link.

6. The flip headrest device according to claim 3, wherein the sofa frame top defines two sofa frame top openings for the first link and the second link passing therethrough.

7. The flip headrest device according to claim 3, wherein the driving member is an electric push rod.

8. The flip headrest device according to claim 3, wherein a fixing base is fixedly connected between the two sofa frame sides, and a lower end of the driving member is rotatably connected to the fixing base.

9. The flip headrest device according to claim 2, wherein the headrest portion is fixedly connected to a headrest fixing portion, and the headrest fixing portion is rotatably and respectively connected to the first link and the second link.

10. The flip headrest device according to claim 2, wherein the first link and the second link are both plate-shaped structures, one of the first link and the second link is partially or completely covers the other one of the first link and the second link.

11. The flip headrest device according to claim 2, wherein the sofa frame top defines two sofa frame top openings for the first link and the second link passing therethrough.

12. The flip headrest device according to claim 2, wherein the driving member is an electric push rod.

13. The flip headrest device according to claim 2, wherein a fixing base is fixedly connected between the two sofa frame sides, and a lower end of the driving member is rotatably connected to the fixing base.

14. The flip headrest device according to claim 1, wherein the headrest portion is fixedly connected to a headrest fixing portion, and the headrest fixing portion is rotatably and respectively connected to the first link and the second link.

15. The flip headrest device according to claim 1, wherein the first link and the second link are both plate-shaped structures, one of the first link and the second link is partially or completely covers the other one of the first link and the second link.

16. The flip headrest device according to claim 1, wherein the sofa frame top defines two sofa frame top openings for the first link and the second link passing therethrough.

17. The flip headrest device according to claim 1, wherein the driving member is an electric push rod.

18. The flip headrest device according to claim 17, wherein a return spring is disposed between a push rod of the electric push rod and a lower end of the sofa frame.

19. The flip headrest device according to claim 1, wherein a fixing base is fixedly connected between the two sofa frame sides, and a lower end of the driving member is rotatably connected to the fixing base.

* * * * *